US005916320A

United States Patent [19]

Stinnertz et al.

[11] Patent Number: 5,916,320

[45] Date of Patent: Jun. 29, 1999

[54] METHOD FOR MANUFACTURING TUBES USING THE COLD PILGER ROLLING METHOD

[75] Inventors: Horst Stinnertz, Willich; Michael Baensch, Mönchengladbach, both of Germany

[73] Assignee: Mannesmann Aktiengesellschaft, Düsseldorf, Germany

[21] Appl. No.: 09/032,649

[22] Filed: Feb. 27, 1998

[30] Foreign Application Priority Data

| | | | |
|---|---|---|---|
| Oct. 8, 1997 | [DE] | Germany | 197 45 603 |
| Nov. 6, 1997 | [DE] | Germany | 197 50 787 |

[51] Int. Cl.[6] ..... B21D 7/02

[52] U.S. Cl. ..... 72/214; 72/226; 72/365.2; 72/450; 72/208

[58] Field of Search ..... 72/208, 214, 226, 72/234, 365.2, 368, 449, 450

[56] References Cited

U.S. PATENT DOCUMENTS

| | | | |
|---|---|---|---|
| 3,650,138 | 3/1972 | Persico | 72/214 |
| 4,052,898 | 10/1977 | Miller et al. . | |
| 4,386,512 | 6/1983 | Rehag et al. | 72/214 |
| 4,541,262 | 9/1985 | Peytavin | 72/250 |
| 5,224,369 | 7/1993 | Rehag et al. . | |
| 5,351,515 | 10/1994 | Astley et al. | 72/214 |
| 5,419,173 | 5/1995 | Baensch et al. | 72/214 |
| 5,540,076 | 7/1996 | Baensch et al. | 72/214 |

FOREIGN PATENT DOCUMENTS

| | | | |
|---|---|---|---|
| 0 524 711 | 1/1993 | European Pat. Off. | B21B 21/00 |
| 604 909 | 10/1934 | Germany . | |
| 604909 | 11/1934 | Germany . | |
| 25 28 850 | 1/1977 | Germany | B21B 21/00 |
| 54-12256 | 5/1979 | Japan | 72/214 |
| 63-260607 | 10/1988 | Japan | B21B 21/00 |
| 505453 | 11/1976 | U.S.S.R. | 72/214 |
| 1261106 | 1/1972 | United Kingdom | B21B 13/18 |

*Primary Examiner*—Joseph J. Hail, III
*Assistant Examiner*—Ed Tolan
*Attorney, Agent, or Firm*—Cohen, Pontani, Lieberman & Pavane

[57] ABSTRACT

Disclosed are a method and apparatus for manufacturing tubes, preferably tubes composed of high-tensile steels or special alloys, using the cold pilger rolling method with two rolling stands which can be moved backward and forward, at least in opposite directions at times and in the rolling direction by means of crank drives. The rolling stands have rollers which are calibrated in a tapering manner and which, driven by toothed racks via cogs, roll over the material to be rolled, with an alternating rotation direction. The majority of the forming work takes place on the first rolling stand and a relatively small portion of the forming work takes place on the second rolling stand and additional smoothing work is carried out. Reduction rolling takes place in both rolling stands via a mandrel which is matched to the roller caliber, and the backward and forward movements of the two rolling stands are matched to one another in such a manner that the angular offset between the crank drives is chosen such that the forming zone of the first stand does not occur at the same time as the forming zone of the second stand.

18 Claims, 2 Drawing Sheets

METHOD FOR MANUFACTURING TUBES USING THE COLD PILGER ROLLING METHOD

BACKGROUND OF THE INVENTION

The invention relates to a method and an apparatus for manufacturing tubes, preferably composed of high-tensile steels or special alloys, using the cold pilger rolling method with two rolling stands which can be moved backward and forward, at least in opposite directions at times, in the rolling direction by means of crank drives and have rollers which are calibrated in a tapering manner which, driven via toothed racks via cogs, roll over the material to be rolled, with an alternating rotation direction.

A major cost element in the manufacture and operation of cold pilger rolling mills results from the rotation and advance devices required as well as the feed devices which are essential for the cold pilger rolling process. The performance-to-cost ratio can be improved considerably if a significant performance improvement can be achieved while maintaining these devices and without reducing the stand speed. One way to achieve this is to increase the forming work per stand stroke and rolling stand, which results in a considerable improvement in performance for only a minor increase in investment costs. This statement relates to cold pilger rolling mills in general and, in particular to cold pilger rolling for relatively small tubes composed of high-tensile steels or special alloys.

Known cold pilger rolling mills in which rolling is conventionally carried out in one (strand), suffer from relatively high investment costs for relatively low performance in comparison with modern drawing methods. In order to improve the performance, it has been proposed that cold pilger drawing mills be operated with a plurality of parallel (strands), for example two to four. However, such a method of operation means greater stand weight with reduced speed and an increased complexity for the feeding and the rotation advance devices, while obtaining rolled tubes having tolerances which leave something to be desired.

The use of so-called tandem cold pilger rolling mills have already been attempted. In that system, two roller pairs are combined sequentially in one stand. Once again, the relatively high stand weight and low speed are evident in a poor cost-to-performance ratio. Both sets of rollers roll the advanced tube volume at the same time. The rolled tube length from the first set of rollers is supplied to the second set of rollers during the advance. This can result in bulging problems in the tube, associated with reductions in performance and quality.

Finally, FIGS. 5 and 6 of German Patent Specification 604 909 show a cold pilger rolling mill which has two rolling stands which can be moved backward and forward in opposite directions at times in the rolling direction. The rolling stands are moved by means of crank drives. The rollers are driven with an alternating rotation direction via toothed racks. The known arrangement provides for the billet to be reduced in diameter exclusively in the first rolling stand, and without any mandrel, so that the wall thickness of the tube can then be reduced using a mandrel in the second rolling stand. The arrangement of the crank drives is chosen such that the movement sequences of the two rolling stands, together with the movement of the mandrel rod and the gripping of the rollers, allow the tube to be advanced in a specific manner.

Although the explanation of the method of operation of the known rolling mill arrangement does not make it possible to identify the precise method sequence when tubes are being rolled, it is, however, evident that this rolling mill could, in any event, be operated at a low performance level which was admittedly adequate in the past, but no longer meets the requirements for a modern cold pilger rolling mill. The hollow rolling in the first stand leads to deterioration of the inner surface that is currently unacceptable and results in only a small, if any at all, performance improvement, since the significant wall reduction is carried out exclusively in the second stand.

The object of the present invention is to provide a cold pilger rolling method and an apparatus for manufacturing tubes, in particular composed of high-tensile steels or special alloys, using the cold pilger rolling method, in which a significant improvement in the rolling performance over conventional rolling mills is obtained with as little additional mechanical complexity as possible and without any reduction in quality.

SUMMARY OF THE INVENTION

The above stated object is obtained by the method of the invention wherein the majority of the forming work takes place on the first rolling stand, a relatively small portion of the forming work is performed on the second rolling stand and additional smoothing work is carried out. In the method of the invention, reduction rolling takes place in both rolling stands via a mandrel which is matched to the roller caliber. An angular offset between the crank drives is chosen such that the forming zone of the first stand does not occur at the same time as the forming zone of the second stand.

The method according to the invention enables extremely high performance for the first time since only forming work and no smoothing work is carried out in the first rolling stand. This separation makes it possible to use a considerable lengthening of the reduction caliber. There is no need to take into account any tolerance requirements that reduce performance, while significant additional forming work, in addition to the smoothing work, is also carried out in the second rolling stand.

The choice of the phase angles between the two rolling stands and the design of the rolling tools are subject to considerably fewer restrictions if the rollers in the second rolling stand release the tube at times which can be defined separately, in that an annular gap is formed between the tube and the rollers at times. Accordingly, in one embodiment of the invention the second roller stand is arranged with the crank angle offset by about 180 degrees with respect to the first stand and, during the reverse stroke when no reduction takes place, opens up an annular gap, which corresponds to the material offered from the first stand, between the material to be rolled and the roller caliber, into which annular gap the tube which has been formed in the first rolling stand is inserted.

This method is advantageously implemented by the capability to adjust the angles of at least the rollers in the second rolling stand cyclically during rolling. According to the invention, the rollers can be adjusted by horizontal displacement of the toothed racks, changing the action of the roller caliber relative to the material being rolled.

Alternatively, the distance between the roller axes can be varied cyclically during the rolling process so as to provide the space required in the roller caliber to accommodate the material offered from the rolling process in the first rolling stand.

In order to save mechanical complexity for cyclic production of the annular gap between the caliber envelope and the material to be rolled, the second rolling stand alternatively is arranged at a crank angle offset through about 90 to 150 degrees with respect to the first rolling stand. The rollers are driven to rotate by means of fixed-position toothed racks and the distance between the roller axes remain constant during rolling.

Apparatus for performing the method includes a first rolling stand, in the form of a break-down stand with rollers which have only the working caliber, and rollers of the second rolling stand which have working and smoothing calibers. The rollers of both rolling stands interact with correspondingly calibrated rolling mandrels. The crank drives, which are offset at an angle to one another, are designed to drive the rolling stands via individual push rods which are allocated to each rolling stand and have vertical axes of rotation, the two cranks rotating in mutually opposite directions.

A cold pilger rolling mill in accordance with the invention allows the rolling performance to be improved considerably over that of conventional rolling mills. Because the first rolling stand has rollers which have only the working caliber, the forming work in this stand can be increased considerably since there is no need to perform smoothing work in this stand. Thus, the entire caliber envelope can be used for the forming work. The smoothing work is not performed until the second rolling stand, in the smoothing caliber provided there, upstream of which there is arranged a working caliber by means of which it is once again possible to carry out additional, significant forming of the tube. In this case, the mechanical complexity for the rotation and advance drive as well as that for loading with new billets is unchanged, and is no greater than that for a normal, single cold pilger rolling mill. The arrangement of the crank drive angles with respect to one another according to the invention allows the billet to be rotated and advanced at suitable times and, together with further features according to the invention, prevents material jams from occurring between the roller stands while the main forming work is being performed on the first rolling stand. The rotation of the two cranks in opposite directions allows good compensation for first-harmonic mass forces and thus makes high speeds feasible, which do not need to be reduced in comparison with those of a conventional single cold pilger rolling mill since the arrangement does not increase the mass forces.

The mechanical complexity of such a crank drive is only negligibly greater than for driving a single stand. Arranging the crank drives with their rotation axes oriented vertically avoids the need for deep foundations for mass balancing. The distance between the two rolling stands may be minimized, for example, if, according to an embodiment of the invention, the push rods of each rolling stand revolve in planes located one above the other or the two rolling stands are arranged above the crank drive in such a manner that the hinge points for the push rods are located at the two points of the rolling stand furthest away from one another.

A common crank drive with rotating balance weights on the two contrarotating crank bends is preferably provided for both rolling stands. Balance weights are used to compensate for first-order mass forces. The interaction of the stand masses at least partially balances second-order mass forces. From the aspect of mass force balancing, a phase angle of 90° is optimum since, with this precondition, the second-order mass forces also cancel one another out. However, it is not possible to preclude rolling difficulties with such an arrangement.

In one embodiment of the invention, the cranks are driven in the same rotational direction and a portion of the first-order mass forces is, in each case, compensated for by counterweights on the cranks. The remaining portion of this mass force component is either not compensated for, or is compensated for by counterweights on an intermediate shaft which connects the two cranks via gear wheels and rotates at the same speed as the cranks, but in the opposite rotational direction.

Alternatively, it is possible to allocate to each rolling stand its own crank drive with mass balancing, in which case the drive for the second rolling stand can be designed to be weaker than that for the first rolling stand. This results in the drive for the second stand being smaller, lighter and less expensive than that for the first rolling stand. The phase angle between the two stands can easily be varied by using two separate crank drives.

Furthermore, it is possible to accommodate in one housing the cranks which drive the two rolling stands with each stand being driven by a separate motor so that the phase angle of the two cranks can easily be varied. The first-order mass balancing then requires two rotating weights on each crank in such a manner that the larger weight is firmly connected to the crank while the position of the smaller, with respect to the crank, is adjustable, for example as an eccentric which can be twisted about the crank center.

In another embodiment of the cold pilger rolling mill according to the invention, the two rolling stands are of different weights and can be moved with different strokes, appropriate counterweights on the contrarotating shafts or cranks once again ensuring complete compensation for first-order mass forces.

In order to vary the annular gaps between the caliber envelope and the material to be rolled, another feature of the invention provides that at least the toothed racks of the second rolling stand are provided with a displacement device for displacing the toothed racks in their longitudinal extending directions.

Alternatively, it is proposed that a wedge mechanism which can be used cyclically, be provided in order to adjust the distance between the axes of at least the rollers and the second rolling stand.

In rolling terms, it is particularly advantageous to operate the crank drives with a phase angle of 180°, so that rotation and advance can be carried out at both dead points. The double rotation and advance further improves both the production rate and the production quality, as in the case of conventional rolling mills as well. However, in this embodiment, the second-order mass forces are additive and it appears to be necessary to produce the annular gap between the material to be rolled and the caliber envelope cyclically during the return stroke of the second stand.

Cold-pilger rolling of thin-walled tubes with small diameters can be performed with any required rotation and advance movement, for example even with continuous movements. When a rolling mill according to the invention is used, the thin-walled tube is completed by the second rolling stand. Since, in this case, the tube can be supplied to the second rolling stand in any required manner, the rotation and advance movement can be defined independently of the phase angles of the two rolling stands, exclusively on the basis of the requirements of the first rolling stand, for example as rotation and advance at both dead points as well. In the case of these thin-walled products, the cold pilger method also allows the tube to be rotated and advanced even though the rollers are still in contact with the tube on the smoothing caliber. This means that the caliber of the rollers in the second rolling stand may also be extended as far as the outlet dead point of the rolling stand.

The invention combines a series of advantages over the prior art. Since the mechanical complexity for the rotation and advance drive and for loading with new billets is not greater than that of a normal single cold pilger rolling mill, the rolling mill of the invention can be manufactured with a good cost-to-performance ratio. The rolling mill can be operated at high speeds which need not be reduced in comparison with those of a normal single rolling mill, since the stand and crank drive arrangement does not increase the mass forces. The mechanical complexity for the crank drive is only negligibly greater than that for driving only one stand. The fact that the caliber length of the first stand can be used completely for forming must be emphasized in particular, since there is no need for a smoothing caliber here, or to consider tolerance requirements. This results in a significant improvement in performance. The performance can be further improved by performing additional forming in the second stand. At the same time, this results in the capability to use a considerably longer smoothing caliber in the second rolling stand than that in previous rolling tools and thus to reduce the manufacturing tolerances even further, despite an increased production rate.

The various features of novelty which characterize the invention are pointed out with particularity in the claims appended to and forming a part of this specification. For a better understanding of the invention, its operating advantages and specific objects obtained by its use, reference should be had to the accompanying drawings and descriptive matter in which there is illustrated and described a preferred embodiment of the invention.

DESCRIPTION OF THE PREFERRED EMBODIMENT

Figure 1:
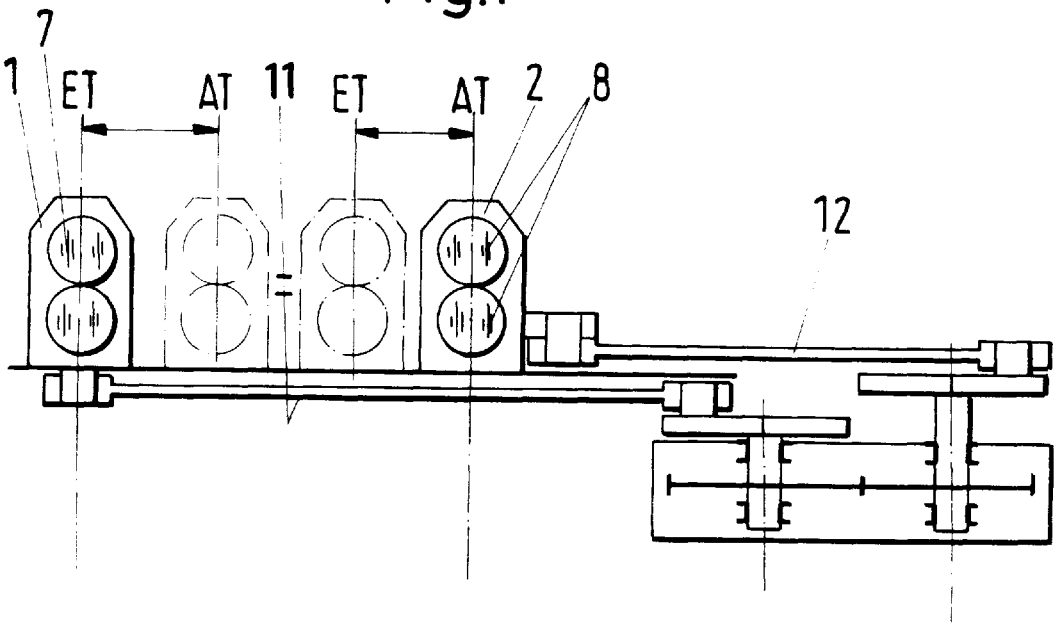
FIG. 1 shows a rough, schematic side view of a rolling mill according to the invention.
Figure 2:
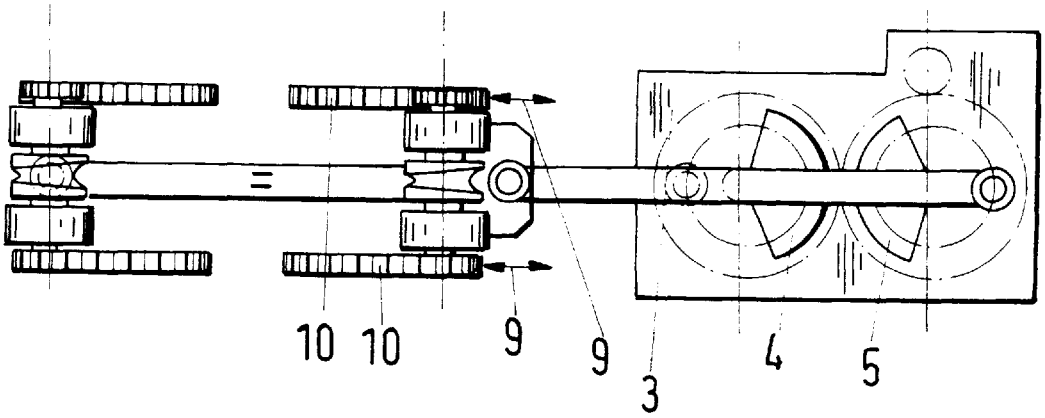
FIG. 2 shows a plan view of the rolling mill according to FIG. 1.

Referring to FIG. 1, two rolling stands 1 and 2 are driven by a common crank drive 3 so that the first-order mass forces of the two rolling stands are completely balanced. The contrarotating balance weights 4 and 5 (FIG. 2) in this exemplary embodiment compensate only for rotational unbalances of cranks and push rods.

Each rolling stand 1 and 2 is driven by only one of the push rods 11 and 12. Each push rod moves in a plane and the planes for the respective rods are located one above the other. This is accomplished by a hinge point for the first rolling stand 1 being provided under the latter, and that for the second rolling stand 2 being provided under the latter, and that for the second rolling stand 2 being provided in front of it. At the inlet dead point ET, both sets of rollers 7 and 8 release the material to be rolled to rotate and to be advanced, and the rolled material is once again briefly released at the outlet dead point AT, for additional rotation.

While the advance volume is rolled out on the advance of the rolling stand 1 from ET to AT and is correspondingly lengthened, the rollers 8 in the rolling stand 2, which is on its reverse stroke, are rotated by means of an adjusting device 9 for the toothed racks 10 such that the rollers 8 in the rolling stand 2 have no reducing effect, or have only an insignificant reducing effect, during its movement from AT to ET. In the inlet area, the adjusting mechanism 9 counteracts this movement. On the way from ET to AT, when the rolling stand 1 is on its reverse stroke doing virtually no plastic forming work, the advance volume which has already been stretched on the forward stroke of rolling stand 1 is rolled out in the rolling stand 2 with the length advance multiplied by the strain of the first stand 1.

A feature of the illustrated rolling mill according to the invention, whose performance is roughly twice that of a conventional rolling mill, is that the entire rotation, advance and feed device remains unchanged, the oscillating balance masses of a conventional rolling mill are replaced by a second rolling stand, and only the additional roller shafts, with their toothed rack drives, need be added.

The following two exemplary embodiments which further describe the invention. Example 1 describes a classic stainless-steel rolling system for heat exchanger tubes, and Example 2 explains the utilization of the high level of ductility of austenitic steels for relatively large cross section reduction.

EXAMPLE 1

Table 1 shows the data for a classic stainless-steel rolling system for 16×1 heat exchanger tubes which, based on experience, can be rolled with about 18 mm rolled-out tube length per stand stroke which, together with 320 strokes per minute, leads to a theoretical rolling performance of 346 m/h. In this case, 100 mm of the total caliber length of 370 mm is provided for the smoothing caliber, that is to say about 27% which makes virtually no contribution to forming.

In a rolling mill according to the invention, no smoothing caliber is required in the first stand, so that the forming zone is correspondingly extended to 370 mm. This, together with the fact that the reduction produced in the first stand is only from 33×3.5 to 20×1.5, allows a minimum 15% increase in the yield in mm per stand stroke. Since not only the complete tube length per stroke but also the tube cross section has been increased, from 18×1 to 20×1.5, this results in an increase in the weight passing through from 128 to 272 kg/h, that is to say a 113% improvement in performance.

The advance of 5.6 mm in the first stand takes place when the first stand is at the inlet dead point and the second stand is at the outlet dead point. That is to say the forming in the first stand takes place essentially on its forward stroke, while the second stand is on its return stroke. Thus 5.6 mm length is added to the advance volume of 20×1.5 in the second stand, in its outlet dead point area, which is extended during its reverse stroke to 20.7 mm. Before the start of its forward stroke, the second stand is thus given an advance of 20.7 mm, which is rolled out in the second stand to 38 mm, with a strain of 1.85 times.

During operation, the rolled material is to be advanced without any impediment while the second stand is on its reverse stroke, as well. To do this in the presently exemplified embodiment, the toothed rods which drive the rollers to rotate are adjusted cyclically, causing the rollers to rotate such that they release the tube on the reverse stroke. This adjustment is then canceled out in the changeover area of the inlet dead point. Thus, before the start of rolling on the forward stroke, an advance of 20.6 mm is applied, and the rollers are once again in the correct rolling position. The 20.6 mm advance is now rolled out on the forward stroke, with a strain of 1.85 times, to give a tube length of 38 mm per stroke. The performance of the rolling mill according to the invention is thus increased to 2.13 times that of a conventional rolling mill.

Figure 3:
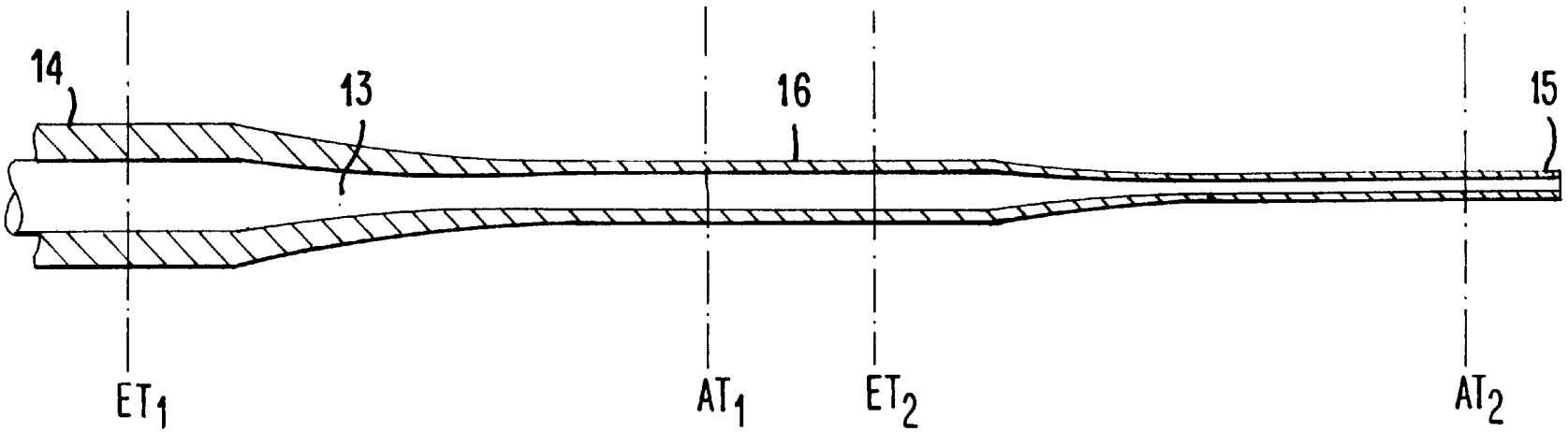
FIG. 3 shows in cutaway a mandrel used in the present invention.

FIG. 3 shows in partial cutaway a mandrel rod 13 on which the partially reduced diameter tube is formed. Between the frame dead point ET1 and AT1 the rollers 7 of the first roller frame 1 roll down and between ET2 and AT2 the drums 8 of the second roller frame 2. The correspondingly shaped rollers 7 and 8, together with the also correspondingly shaped stationary mandrel rod 13, form the finished tube 15 in two converter steps from the ingot 14. Thus, in the first roller frame 1 by break-down-rolling using large capacity and relatively crude tolerances, the fractional size 16 is produced. In the second roller frame 2 it is further reduced and smoothed out. Rollers 7 and 8 and mandrel rod 13 are shaped so that in both roller frames the diameter, as well as the wall of the object being rolled, is reduced. The mandrel rod 13 can thus be a one-piece or a multi-part-piece construction of partial lengths, for example for the first and second forming zone.

TABLE 1

| Identical strain | | Conventional mill | Mill according to the invention 1st stand | Mill according to the invention 2nd stand |
|---|---|---|---|---|
| Billet external diameter | mm | 33 | 33 | 20 |
| Billet wall | mm | 3.5 | 3.5 | 1.5 |
| Tube external diameter | mm | 16 | 20 | 16 |
| Tube wall | mm | 1 | 1.5 | 1 |
| Strain | — | 6.88 | 3.72 | 1.85 |
| Speed | $min^{-1}$ | 320 | 320 | 320 |
| Total caliber length | mm | 370 | 370 | 370 |
| Reducing caliber length | mm | 270 | 370 | 270 |
| Smoothing caliber length | mm | 100 | 0 | 100 |
| Tube per stroke | mm | 18 | 20.7 | 38 |
| Partial strain | — | 6.88 | 3.72 | 1.85 |
| Advance | mm | 2.6 | 5.6 | 20.7 |
| Theor. performance | m/h | 346 | 397 | 735 |
| | kg/h | 128 | 272 | 272 |
| | % | 100 | 115 | 213 |

EXAMPLE 2

While the first example shows the improvement in performance with an unchanged tube cross section, the second example is intended to utilize the great ductility of austenitic steels in order to increase the strain by the rolling mill according to tie invention.

The example shows, for the conventional rolling mill, the rolling of 33×3.5 to 16×1 from Example 1, but for the rolling mechanism according to the invention from 33×3.5 to 12×1. The yield in m/h is in this case roughly doubled and the throughput in kg/h is still increased by virtually 50% despite the lower weight per meter.

TABLE 2

| Increased strain | | Conventional mill | Mill according to the invention 1st stand | Mill according to the invention 2nd stand |
|---|---|---|---|---|
| Billet external diameter | mm | 33 | 33 | 16 |
| Billet wall | mm | 3.5 | 3.5 | 1.3 |
| Tube external diameter | mm | 16 | 16 | 12 |
| Tube wall | mm | 1 | 1.3 | 1 |
| Strain | — | 6.88 | 5.40 | 1.74 |
| Speed | $min^{-1}$ | 320 | 320 | 320 |
| Total caliber length | mm | 370 | 370 | 370 |
| Reducing caliber length | mm | 270 | 370 | 270 |

TABLE 2-continued

| Increased strain | | Conventional mill | Mill according to the invention 1st stand | Mill according to the invention 2nd stand |
|---|---|---|---|---|
| Smoothing caliber length | mm | 100 | 0 | 100 |
| Tube per stroke | mm | 18 | 21 | 36 |
| Partial strain | — | 6.88 | 5.40 | 1.74 |
| Advance | mm | 2.6 | 3.9 | 21.0 |
| Theor. performance | m/h | 346 | 403 | 700 |
| | kg/h | 128 | 190 | 190 |
| | % | 100 | 117 | 203 |

The terms and expressions which have been employed are used as terms of description and not of limitation, and there is no intention in the use of such terms and expressions of excluding any equivalent of the features shown and described or portions thereof, it being recognized that various modifications are possible within the scope of the invention.

We claim:

1. A method for manufacturing a tube comprising:

feeding a workpiece to be formed into a tube to a cold rolling mill;

cold rolling said workpiece in said mill, said mill comprising two rolling stands which are movable in a backward and forward direction and optionally opposite directions and in the rolling direction by crank drives, said rolling stands having rollers which are calibrated in a tapering manner and which are driven by toothed racks via cogs, and roll over the workpiece with an alternating rotation direction, wherein the majority of the forming work is performed on the first rolling stand and a relatively small portion of the forming work is performed on the second rolling stand and additional smoothing work is carried out, wherein reduction rolling takes place in both rolling stands via a mandrel which is matched to the roller caliber, and wherein the crank drives are angularly offset such that the forming zone of the first stand does not occur at the same time as the forming zone of the second stand.

2. The method of claim 1 wherein the second rolling stand is arranged with the crank drive angle offset through about 180 degrees with respect to the first stand and, during the reverse stroke when no reduction takes place, opens up an annular gap which corresponds to the workpiece received from the first stand, between the material to be rolled and the roller caliber, into which annular gap the tube which has been formed in the first rolling stand is inserted.

3. The method of claim 1 wherein the toothed racks are cyclically displaced horizontally for the rotational drive.

4. The method of claim 1 wherein the distance between the roller axes is varied cyclically during the rolling process.

5. The method of claim 1 wherein the second rolling stand is arranged at a crank angle offset of about 90 to 150 degrees with respect to the first rolling stand.

6. The method of claim 5 wherein the rollers of the second rolling stand are driven to rotate by fixed-position toothed racks.

7. The method of claim 6 wherein the distance between the roller axes remains constant during rolling.

8. The method of claim 1 wherein the tube is comprised of a high-tensile steel as a special alloy.

9. An apparatus for manufacturing a tube comprising:

two rolling stands which are movable in a backward and forward direction in a guide, and optionally in opposite directions;

crank drives for moving said rollers in the rolling direction;

push rods which are allocated to each rolling stand and have vertical axes of rotation whereby the crank drives drive the rolling stands; and rollers which are calibrated in a tapering manner, said rollers being driven via toothed racks via cogs, to roll over the material to be rolled, with an alternating rotation direction, wherein the first rolling stand is a break-down stand with rollers which have only the working caliber, and the rollers of the second rolling stand have working and smoothing calibers, and a correspondingly calibrated rolling mandrel which interacts with the rollers of both rolling stands.

10. The apparatus of claim 9, wherein each of the push rods of each rolling stand moves in a plane, said planes being vertically displaced one above the other.

11. The apparatus of claims 9 wherein a common crank drive is provided for both rolling stands and has contrarotating cranks and rotating balance weights on the two crank bends.

12. The apparatus of claim 11 wherein the rotating counterbalances completely compensate for first-order mass forces, and partially compensate for higher-order mass forces being provided by the interaction of the stand masses.

13. The apparatus of claim 9 wherein the cranks are driven in the same rotation direction, and a portion of the first-order mass forces of the cranks is in each case compensated for by counterweights, and the remaining portion of this mass force component.

14. The apparatus of claim 9 wherein the cranks are driven in the same rotation direction, and a portion of the first-order mass forces of the cranks is in each case compensated for by counterweights, and the remaining portion of this mass force component for by counterweights on an intermediate shaft which connects the two cranks via gear wheels and rotates at the same speed as the cranks, but in the opposite rotation direction.

15. The apparatus of claim 9 wherein each rolling stand has a corresponding crank drive with mass balancing.

16. The apparatus of claim 15 wherein the drive for the second rolling stand is weaker than that for the first rolling stand.

17. The apparatus of claim 9 wherein at least the toothed racks of the second rolling stand have a displacement device for displacing the toothed racks in their longitudinal extending directions.

18. The apparatus of claim 9 wherein a cyclically adjustable wedge mechanism is provided for adjusting the distance between the axes of at least the rollers in the second rolling stand.

* * * * *